US005311941A

United States Patent [19]

Baugh

[11] Patent Number: 5,311,941

[45] Date of Patent: May 17, 1994

[54] ROTATION RELEASE LATCH FOR A WELLBORE TOOL

[75] Inventor: John L. Baugh, Houston, Tex.

[73] Assignee: Baker Hughes Incorporated, Houston, Tex.

[21] Appl. No.: 928,816

[22] Filed: Aug. 12, 1992

[51] Int. Cl.[5] ..... E21B 23/00

[52] U.S. Cl. ..... 166/208; 166/125; 166/216

[58] Field of Search ..... 166/208, 209, 210, 215, 166/216, 217, 382, 125, 237, 241, 242, 243

[56] References Cited

U.S. PATENT DOCUMENTS

| | | | |
|---|---|---|---|
| 4,690,220 | 9/1987 | Braddick | 166/382 |
| 4,750,563 | 6/1988 | Baugh | 166/216 X |
| 4,811,785 | 3/1989 | Weber | 166/210 X |
| 4,926,936 | 5/1990 | Braddick | 166/216 X |

*Primary Examiner*—Terry Lee Melius

*Attorney, Agent, or Firm*—Felsman, Bradley, Gunter & Dillon

[57] ABSTRACT

A rotation release apparatus is provided for use in a wellbore tool to selectively couple a first wellbore tool member to a second wellbore tool member until the wellbore tool is lowered to a selected depth within the wellbore. The rotation release apparatus includes a coupling member secured to the first wellbore tool member, and a latch member secured to the second wellbore member. A cam member is secured to the coupling member to release the latch member from the coupling member when the wellbore tool is rotated about a longitudinal axis. The rotation release latching apparatus may be operated to couple the latch member to the coupling member by axial movement of the wellbore tool along a longitudinal axis.

10 Claims, 8 Drawing Sheets (DETAIL A-A)

ROTATION RELEASE LATCH FOR A WELLBORE TOOL

BACKGROUND OF THE INVENTION

1. Field of the Invention

This invention relates in generally to release latches for use in wellbore tools which are selectively releasable within a wellbore, and in particular to liner hangers having slip gripping mechanisms which are lowered inside of a casing string in which a plurality of slip elements are selectively releasable to engage at least one cone element and urged into gripping engagement with the casing string to suspend a liner.

2. Description of the Prior Art

Prior art release latches have been utilized to selectively couple a first wellbore tool member to a second wellbore tool member when a wellbore tool is disposed within a borehole. For example, prior art release latches have been used in liner hangers having slip gripping mechanisms which are used in oil and gas completion operations to secure liners within casing strings in wellbores. Slip gripping mechanisms typically include two members, a cone assembly and a slip assembly. The cone assembly and slip assembly are selectively coupled together until a liner and a liner hanger are lowered into a wellbore to a selected depth at which the slip gripping mechanism is operated to grippingly engage the casing to suspend the liner.

A liner hanger is run, or lowered, into a wellbore secured to a liner which is suspended by a workstring, which may be a portion of the liner itself if the liner is to extend to the surface of the wellbore.

While lowering the liner and liner hanger into the wellbore, typically a prior art release latch is utilized to selectively couple the slip assembly so it will not engage the cone assembly until the liner hanger is lowered to the selected depth. The liner hanger slip gripping mechanism is set by uncoupling the slip assembly, and then urging it to engage a cone assembly which forces longitudinally extending slip elements radially outward into gripping engagement with the casing.

One example of a prior art release latch may be found in U.S. Pat. No. 4,750,563, entitled "Slip Gripping Mechanism With Automatic Segment Alignment", issued Jun. 14, 1988 to Hughes Tool Company, Houston, Tex., as assignee from inventor John L. Baugh. U.S. Pat. No. 4,750,563 shows a prior art liner hanger which includes a slip gripping mechanism having a cone assembly and a slip assembly, with a prior art release latch used for selectively uncoupling the slip assembly for setting of the slip gripping mechanism.

Prior art release latches have several problems that arise when running a mechanically actuated liner hanger to secure a liner within a casing string during oil and gas completion operations. A mechanically actuated liner hanger typically includes a slip gripping mechanism that is set to grippingly engage the casing string and support the liner. With a mechanically actuated liner hanger, the slip gripping mechanism is set by mechanically manipulating the workstring. The slip gripping mechanism usually includes a cone assembly and a slip assembly. The cone assembly and the slip assembly are run into the wellbore with the cone assembly secured to the liner, and the slip assembly coupled to the liner. To set the liner hanger slip gripping mechanism, a prior art release latch is operated to release the slip assembly so that it is uncoupled from the liner for engagement with the cone assembly and the casing.

To operate the prior art release latch to uncouple the slip assembly from the liner, the workstring and liner are mechanically manipulated by both rotating the workstring about a longitudinal axis of the workstring, and axially moving the workstring to move the liner hanger axially upwards and downwards along a longitudinal axis of the wellbore. Typically, rotation of the workstring and liner is accomplished by securing the workstring within a rotary table on a rig floor by use of surface slips.

A problem with prior art release latches arises since it is difficult to axially move the workstring either upwards or downwards along a longitudinal axis of the wellbore while maintaining securement of the workstring within the rotary table. Therefore, it is difficult to both rotate and axially move the workstring at the same time making it difficult to operate the prior art release latch to selectively uncouple the slip assembly.

Another problem arises when liner hangers are set at deep wellbore depths. These deep wellbore depths usually call for a liner and liner hanger to be run on a long workstring which may stretch when pulled upwards due to elasticity of the tubular members making up the workstring. Often this stretch phenomena is compounded by completion operations in deviated or horizontal wellbores. This causes problems in both being able to provide sufficient axial displacement downhole to the prior art release latch to uncouple the slip assembly while rotating the workstring, and being able to determine when sufficient axial displacement has been transmitted downhole to the prior art release latch to uncouple the slip assembly for engagement with the cone assembly and casing.

Yet another problem arises if wellbore debris becomes lodged within a prior art release latch. Oil and gas wellbores frequently have debris suspended within drilling fluids. This debris may become lodged within the release latch and prevent operation of the release latch, preventing uncoupling of the slip assembly for engagement with a cone assembly and casing.

SUMMARY OF THE INVENTION

It is one objective of the present invention to provide a rotation release latching apparatus for use in a wellbore tool to selectively couple a first wellbore member to a second wellbore member until the wellbore tool is lowered to a predetermined position within a wellbore.

It is another objective of the present invention to provide a rotation release latching apparatus for use in a wellbore tool to selectively couple a first wellbore member to a second wellbore member until the wellbore tool is lowered to a predetermined position within a wellbore, and for selectively uncoupling the first wellbore tool member f rom the second wellbore tool member by rotation of the first wellbore tool member with respect to the second wellbore tool member, without requiring axial movement between the first and second wellbore tool members.

It is yet another objective of the present invention to provide a rotation release latch for use in a wellbore tool to selectively couple a first wellbore tool member to a second wellbore tool member, to selectively release the first wellbore tool member from the second wellbore tool member by rotating a workstring from which the wellbore tool is suspended, and to selectively couple the first wellbore tool member to the second wellbore tool member by moving the workstring to move the first wellbore tool member with respect to the second wellbore tool member along a longitudinal axis of the wellbore tool.

It is further another objective of the present invention to provide a liner hanger for securing a liner within a casing string in which rotation of the liner hanger selectively releases a slip assembly from securement to the liner to allow setting of a slip gripping mechanism, and axially moving the liner hanger along a longitudinal axis recouples a released slip assembly to the liner to prevent setting of the slip gripping mechanism.

These objectives are achieved as is now described. A rotation release apparatus is provided for use in a wellbore tool to selectively couple a first wellbore tool member to a second wellbore tool member until the wellbore tool is lowered to a selected depth within the wellbore. The rotation release apparatus includes a coupling member secured to the first wellbore tool member, and a latch member secured to the second wellbore member. A cam member is secured to the coupling member to release the latch member from the coupling member when the wellbore tool is rotated about a longitudinal axis. The rotation release latching apparatus may be operated to couple the latch member to the coupling member by axial movement of the wellbore tool along a longitudinal axis.

In preferred embodiment of the present invention, a liner hanger is provided for securing a liner within a casing string by mechanical manipulation of a workstring to which the liner is secured. The liner hanger includes a slip gripping mechanism having a lock ring secured to a cone assembly, and a latch ring secured to a slip assembly. The lock ring has a coupling end to which the latch ring is coupled to prevent setting of the slip gripping mechanism as the liner hanger is lowered within the wellbore. Once at a selected depth, the liner hanger is rotated to release the latch ring from the lock ring, and then the liner hanger may be lowered to engage the slip assembly into the cone assembly to secure the liner to the casing. The latch member may be recoupled to the coupling end of the lock ring by moving the liner hanger upwards within the wellbore.

Additional objects, features and advantages will be apparent in the written description which follows.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1:
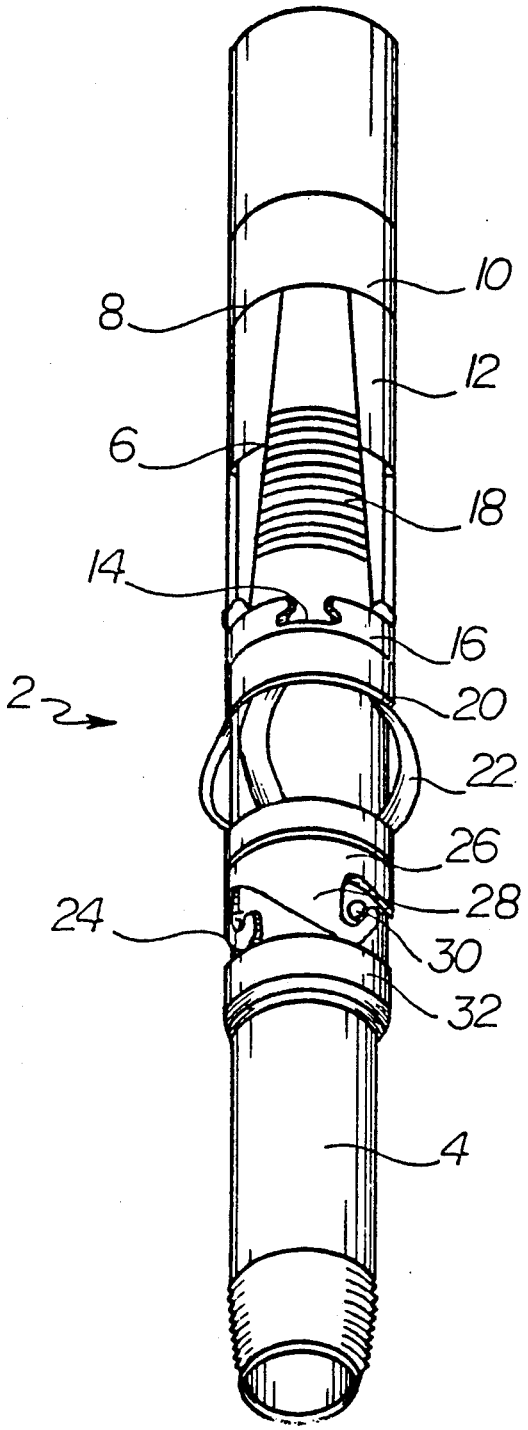
FIGURE 1 (PRIOR ART)
FIG. 1 is a perspective view depicting a prior art liner hanger having a prior art J-latch assembly which is shown in a coupled position for preventing setting of a slip gripping mechanism.

With reference to FIG. 1, a perspective view depicts prior art liner hanger 2 having prior art J-latch assembly 24, with prior art J-latch assembly 24 shown in a coupled position to prevent setting of slip gripping mechanism 6. The prior art wellbore tool, liner hanger 2, is shown disposed about a tubular conduit, liner 4. Typically, liner hanger 2 and liner 4 are disposed on the end of the workstring (not shown) for lowering within a wellbore to a selected position within a casing string (not shown). The workstring (not shown) on which the liner is suspended may be a portion of the liner 4 itself if liner 4 is to be run to the surface of the wellbore.

Liner hanger 4 includes slip gripping mechanism 6 which is utilized to secure the liner hanger and liner to the casing (not shown). Slip gripping mechanism 6 includes a cone assembly 8 having a cone ring 10 circumferentially disposed about liner 4. A plurality of cone elements 12 extend longitudinally along liner 4 and are secured to the liner by cone ring 10. Slip gripping mechanism 6 further includes slip assembly 14 circumferentially disposed about liner 4. Slip assembly 14 includes a slip ring 16 to which a plurality of longitudinally extending slip elements 18 are secured.

Drag spring assembly 20 is secured to slip ring 16. Drag spring assembly 20 includes a plurality of drag springs 22 which grippingly engage the interior of an outer casing string (not shown). Drag spring assembly 20 is in turn secured to prior art J-latch assembly 24.

J-latch assembly 24 includes a J-hook ring 26 from which extends a plurality of J-hooks 28. J-hook ring 26 is secured to drag spring assembly 20. J-hooks 28 are coupled to J-latch lugs 30 which are included as part of J-latch lug ring 32. J-latch lug ring 32 is secured to liner 4.

Figure 2:
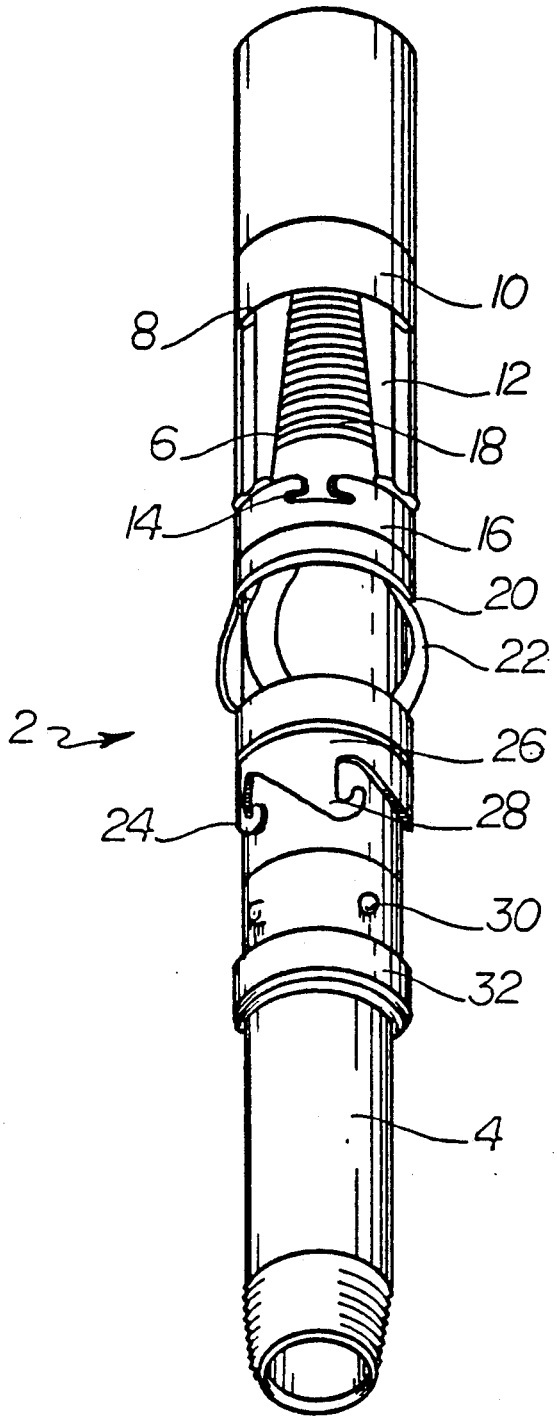
FIGURE 2 (PRIOR ART)
FIG. 2 is a perspective view depicting the prior art liner hanger of FIG. 1 with the prior art J-latch assembly in an uncoupled position and the slip gripping mechanism in a set position.

Referring to FIG. 2, a perspective view is shown of prior art liner hanger 2 having prior art J-latch assembly 24, with prior art J-latch assembly 24 shown in an uncoupled position and slip gripping mechanism 6 shown in a set position. Liner hanger 2 is set to secure liner 4 within casing (not shown) by first uncoupling prior art J-latch assembly 24. J-latch assembly 24 is uncoupled by mechanical manipulation of liner 4 in which liner 4 is moved axially upwards within the wellbore as it is rotated to the left, which is rotation that would be viewed as counter clockwise rotation when looking downhole from the surface of the wellbore.

The following terms are defined for use herein. Axial movement is defined as movement in a direction along the longitudinal axis of the wellbore tool. Rotation is defined as being rotation about a longitudinal axis of the wellbore tool, with rotation to the left herein defined to be the direction of rotation of a workstring which would be viewed as counter clockwise rotation when looking downhole from the surface of the wellbore.

Radial displacement is defined as displacement in a direction which is perpendicular to the longitudinal axis of the wellbore tool.

When liner 4 is being mechanically manipulated by axially moving and rotating the workstring (not shown), drag spring 22 of drag spring assembly 20 press against the interior of the casing string (not shown) to hold J-hook ring 26 and J-hook 28 in place with respect to the casing (not shown). With J-hook 28 held in place as liner 4 is moved axially upwards and rotated to the left, J-latch assembly 24 is unlatched by J-latch lug 30 moving upwards and to the left with respect to J-hook 28 to move J-hook 28 from a coupled to an uncoupled position.

With J-hook 28 in an uncoupled position, slip assembly 14 is free to move with respect to liner 4. Liner 4 is then slacked off, or moved axially downhole, with drag spring assembly 20 holding slip assembly 14 in place within the casing (not shown) as cone assembly 8, which is secured to liner 4, is moved downhole. This relative movement between cone assembly 8 and slip assembly 14 causes cone elements 12 to wedge between liner 4 and slip elements 18 to force slip elements 18 radially outward into gripping engagement with the wellbore casing (not shown).

Referring to FIGS. 1 and 2, uncoupling of J-hook 28 from J-lug 30 requires several inches of axial movement of liner 4 at the surface of the well at the same time that liner 4 is also being rotated. This is often difficult since a heavy casing string, such as liner 4, is rotated by engaging the workstring (not shown) on which it is suspended within a rotary table (not shown) by wedging surface slip elements (not shown) between the rotary table (not shown) and the workstring (not shown). Sufficient axial movement of the workstring at the surface to transmit enough axial movement downhole to liner hanger 2 to uncouple prior art J-latch assembly 24 generally results in urging the surface slips (not shown) from being set in engagement between the rotary table (not shown) and the workstring (not shown). When the surface slips (not shown) are not set, the workstring (not shown) is not securely engaged within the rotary table (not shown), and it is difficult to transmit sufficient rotation downhole to release slip assembly 14 for setting liner hanger 2.

Figure 3A:
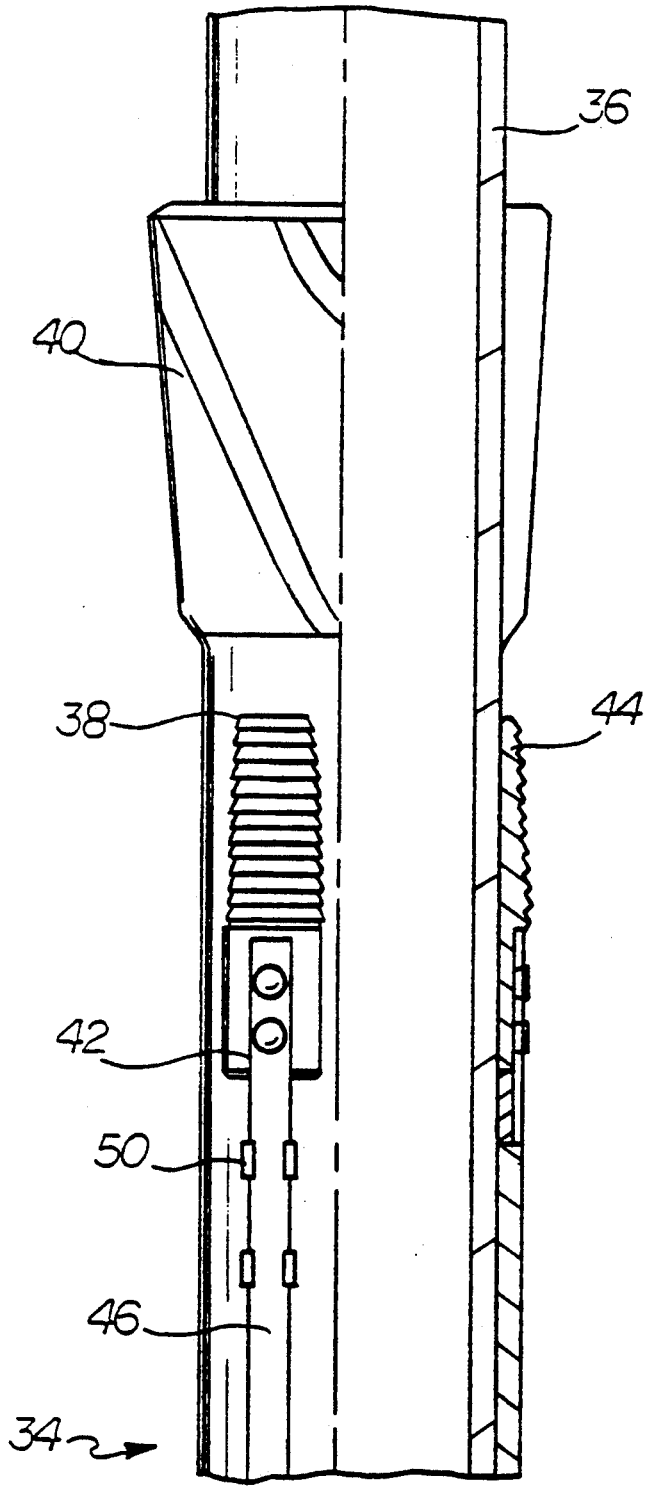
FIGS. 3*a* and 3*b* are one quarter longitudinal section views of the preferred embodiment of the present invention, which when read together, depict a liner hanger having a slip gripping mechanism which includes a cone ring and a slip assembly that are selectively coupled together by a rotation release latch.
Figure 3B:
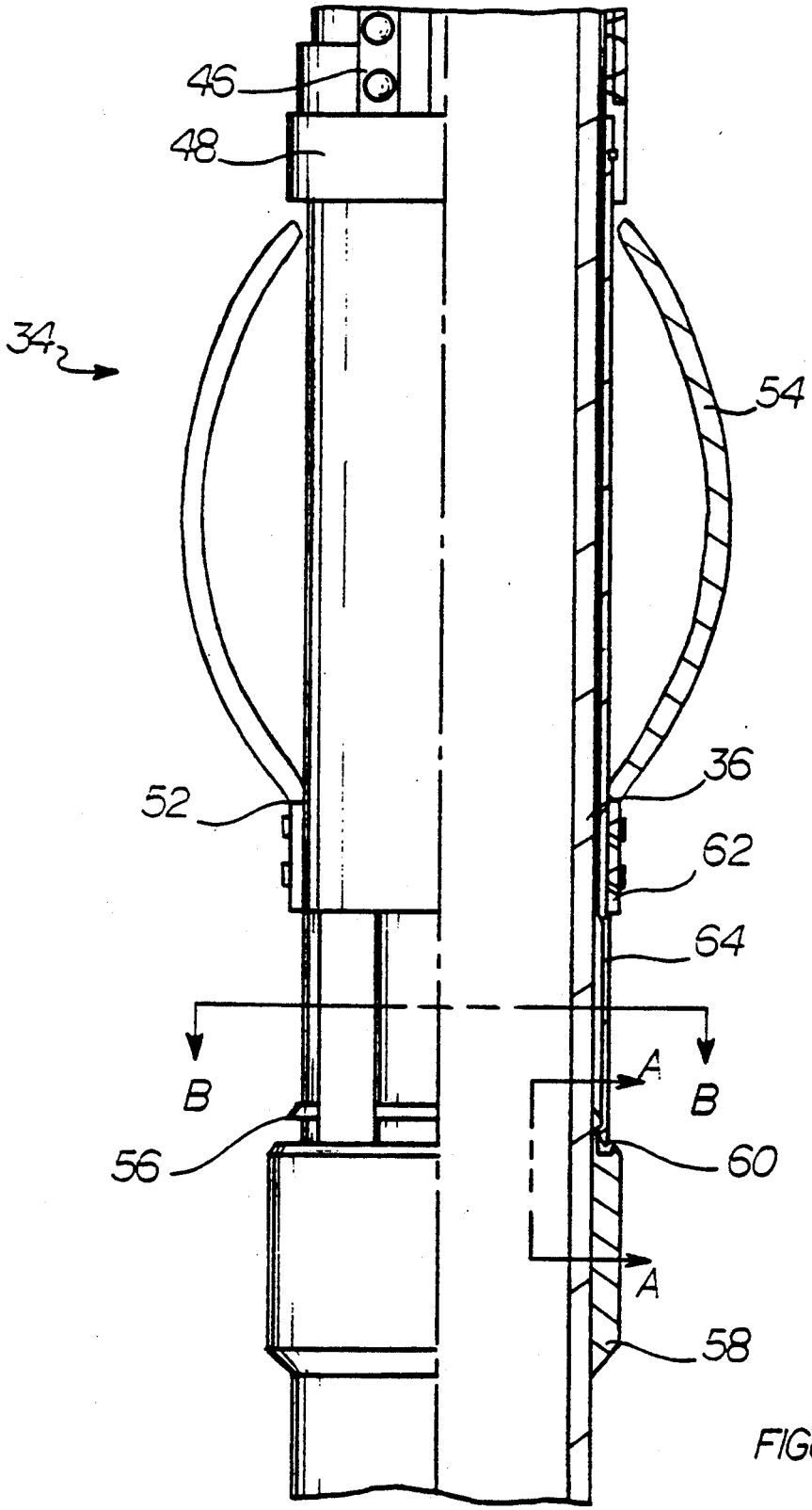

With reference to FIGS. 3*a* and 3*b*, a one quarter longitudinal section view of the preferred embodiment of the present invention depicts a wellbore tool, liner hanger 34. Liner hanger 34 is disposed about liner 36, which is made up of numerous sections of tubular conduits. Liner hanger 34 includes slip gripping mechanism 38 having cone ring 40 and slip assembly 42. Cone ring 40 is a longitudinally extending, fluted, and conically shaped cone element which is threadingly secured to liner 36. In the preferred embodiment of the present invention, cone ring 40 is a first wellbore tool member of liner hanger 34 which is a wellbore tool.

Slip assembly 42 includes a plurality of longitudinally extending slip elements 44, a plurality of slip element arms 46, and a slip ring 48 which are secured one to another. Slip arm guide 50 is provided to guide axial movement of slip element arm 46 with respect to liner 36. In the preferred embodiment of the present invention, slip assembly 42 is a second wellbore tool member of liner hanger 34, which is a wellbore tool.

Drag spring assembly 52 is secured to slip ring 48 and includes a plurality of drag springs 54 which are in turn secured to rotation release latch apparatus 56.

Rotation release latch apparatus 56 includes lock ring 58 having a coupling end 60, and a latch ring 62 having a plurality of longitudinally extending collet fingers 64. In the preferred embodiment of the present invention, there are 3 longitudinally extending collet fingers 64. Drag spring assembly 52 is secured to latch ring 62.

Figure 4:
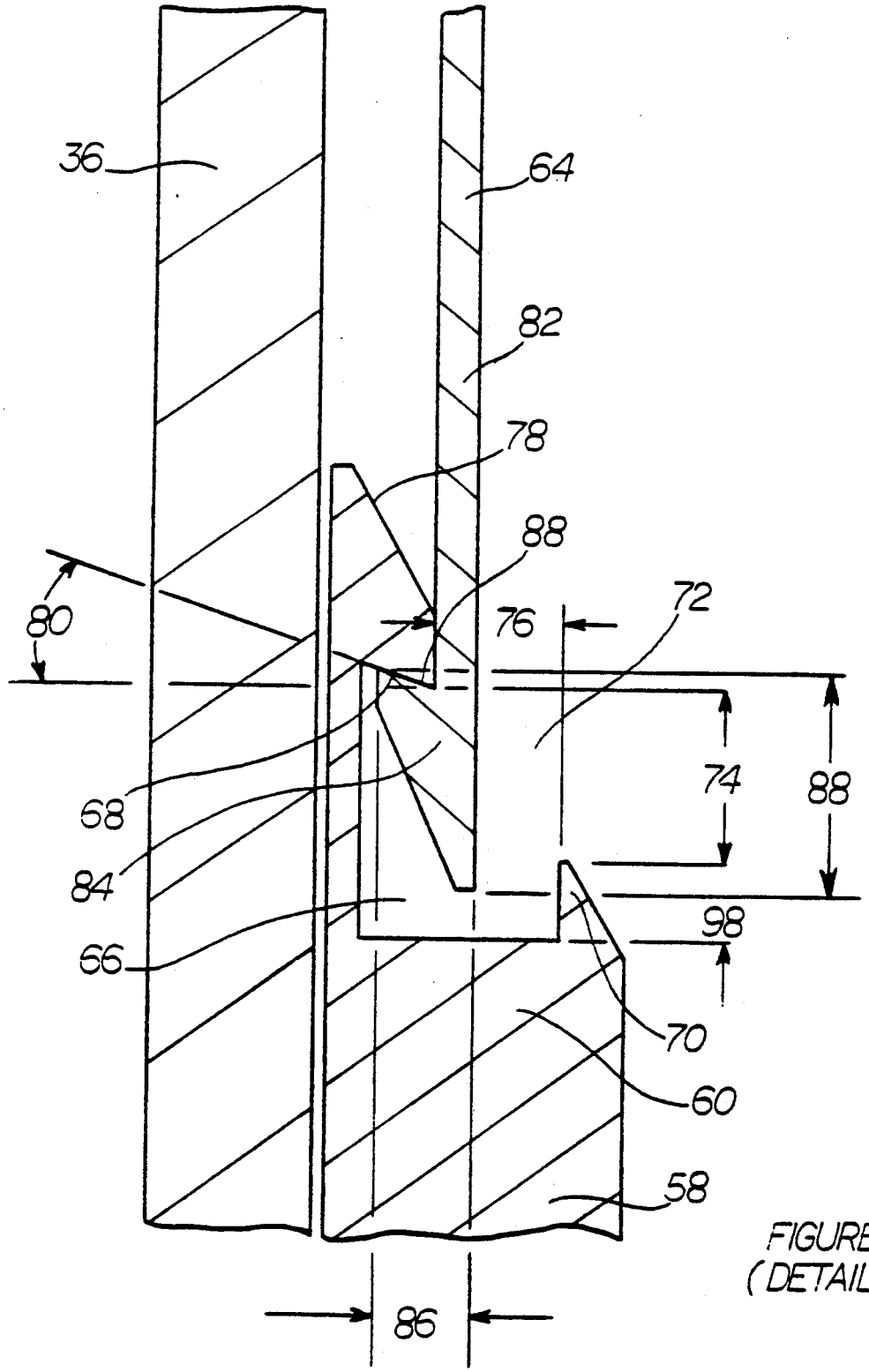
FIG. 4 is a sectional view of the linger hanger of the preferred embodiment of the present invention taken at Section A—A of FIG. 3*b*, and shows a rotation release latch collet finger selectively coupled to a coupling end of a lock ring to prevent setting of the slip gripping mechanism.

Referring to FIG. 4, a sectional view of the preferred embodiment of the present invention is shown as taken along Section A—A of FIG. 3*b*, and depicts rotation release latch collet finger 64 selectively coupled to coupling end 60 of lock ring 58 to prevent setting of slip gripping mechanism 38 (shown in FIGS. 3*a* and 3*b*). Coupling end 60 of lock ring 58 has a coupling groove 66. Coupling groove 66 includes a coupling shoulder 68, coupling retaining lip 70, and a coupling gap 72 between coupling shoulder 68 and coupling retaining lip 70. Coupling gap 72 has both a nominal longitudinal gap dimension 74, extending longitudinally with respect to liner hanger 34, and a radial gap dimension 76, extending along a radial direction with respect to liner hanger 34. Coupling end 60 further has an upward facing conically shaped surface 78. Coupling shoulder 68 faces downward at a shoulder angle 80 from a radial direction with respect to liner hanger 34, which measures 15 degrees in the preferred embodiment of the present invention.

Collet fingers 64 each have a collet finger arm 82 and a collet finger tip 84. Collet finger tip 84 has an upwardly facing collet finger latch shoulder 86 having a shoulder angle 80 from a radial direction with respect to liner hanger 34 for mating in abutment with coupling shoulder 68 when in a latched position as shown in FIG. 4. Collet finger tip 84 further has a radially extending tip width 88 which extends in a radial direction with respect to liner hanger 34, and a longitudinally extending tip length 90 which extends parallel to the longitudinal axis of liner hanger 34 and liner hanger 36.

Collet fingers 64 may be coupled to coupling end 60 of lock ring 58 by insertion of collet finger tip 84 into coupling groove 66 by axially moving collet fingers 64 longitudinally along liner 36. Upward facing conical surface 78 of coupling end 60 provides a beveled surface to help guide collet finger tip 84 into coupling groove 66. Once collet finger tip 84 is within coupling groove 66, collet finger arm 82 provides a biasing means for moving finger shoulder 86 into a latched position for mating abutment with coupling shoulder 68 by acting as a cantilevered leaf spring. The spring biasing provided by collet finger arm 82 serves as a means for positioning latch shoulder 86 in a latched position for mating abutment with coupling shoulder 68 by both urging latch shoulder 86 into a latched position and retaining latch shoulder 86 in the latched position once disposed therein.

Coupling retaining lip 70 provides a means for positioning latch shoulder 86 in the latched position for mating abutment with coupling shoulder 68 by retaining collet finger tip 84 within coupling groove 66 when collet finger 64 is pushed downward into coupling groove 66. In this preferred embodiment, longitudinally extending tip length 90 is longer than nominal longitudinal gap dimension 74, and coupling retaining lip 70 will retain latch shoulder 86 in the latched position. In addition, in the preferred embodiment of the present invention, radially extending tip width 88 is smaller than radial gap dimension 76 so that collet finger tip 84 may be inserted into coupling groove 66 by axial movement of collet finger 64 with respect to coupling end 60.

Coupling retaining lip 70 further serves as a means for positioning latch shoulder 86 in an unlatched position by preventing collet finger tip 84 from entering into coupling groove 66 when it is radially disposed along side of coupling groove 66 and is in an unlatched position as shown in FIG. 4. Entry of collet finger tip 84 into coupling groove 66 is prevented since the nominal longitudinal gap dimension 74 is smaller than longitudinally extending tip length 90.

Figure 5:
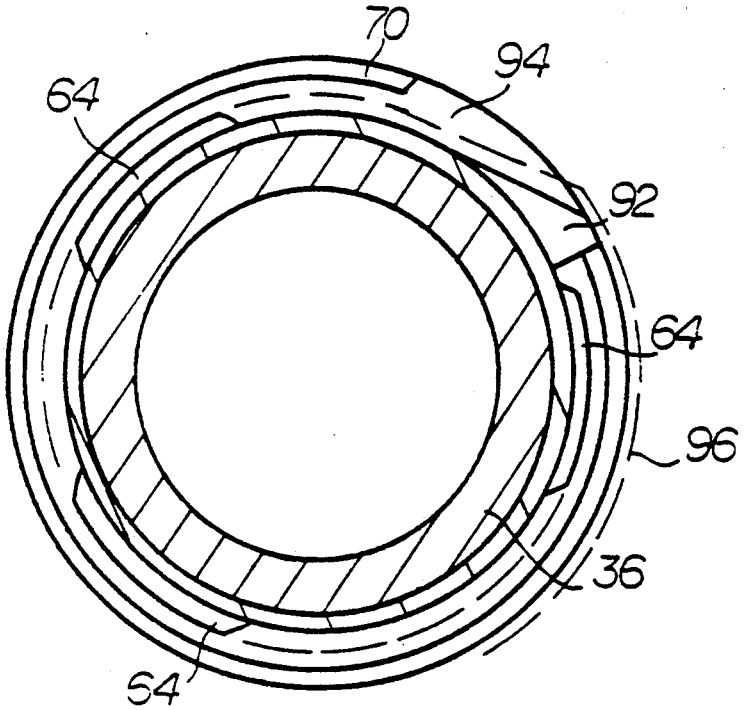
FIGS. 5, 6, and 7 are cross sectional views of the linger hanger of the preferred embodiment of the present invention taken along Section B—B of FIG. 3*b*, and when read together depict operation of the rotation release latch to selectively uncouple the slip assembly.
Figure 6:
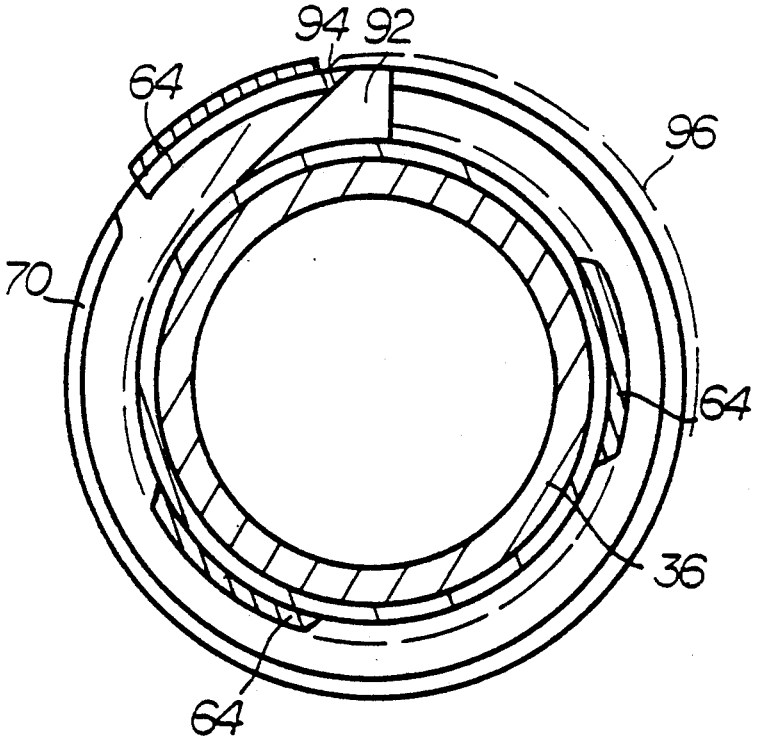
Figure 7:
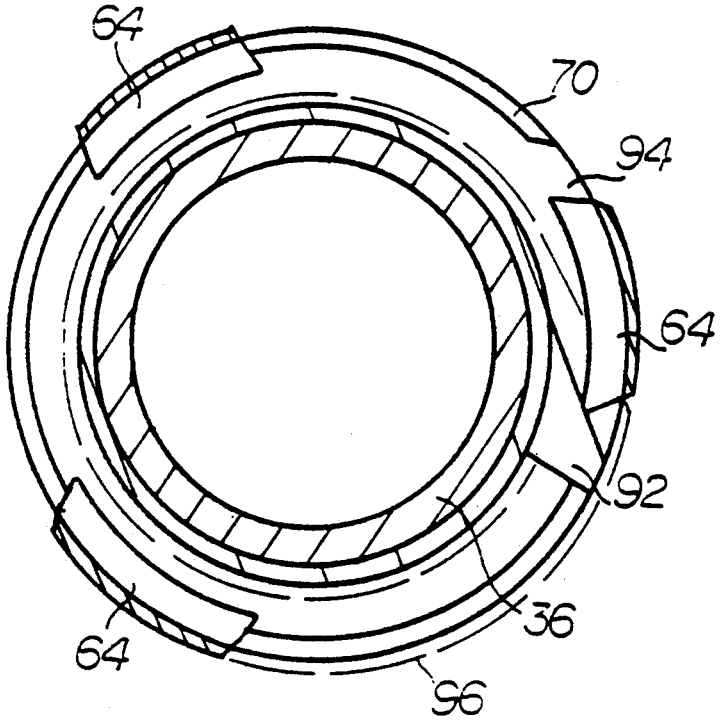

With reference to FIGS. 5, 6, and 7, cross sectional views of the preferred embodiment of the present invention taken along Section B—B of FIG. 3*b* depict liner hanger 34 as rotation release latch 56 is being moved from a coupled position in FIG. 5, to an intermediate position in FIG. 6, to an uncoupled position in FIG. 7. Cam member 92 is secured to coupling end 60 of lock ring 58, and is circumferentially extending to define two circumferential ends for coupling groove 66.

A coupling groove window 94 is defined at one circumferential end of coupling groove 66. Coupling retaining lip 70 is not circumferentially continuous, but has a circumferential end which has a reduced longitudinal lip dimension (not shown), which is smaller than a nominal longitudinal lip dimension, which, together with cam member 92, defines coupling groove window 94. The reduced longitudinal lip dimension further defining an increased longitudinal gap dimension of longitudinal gap dimension 74 to provide coupling groove window 94. Coupling groove window 94 provides a passageway for collet fingers 64 to pass through in traveling in a pathway 96 from a latched position to an unlatched position. Pathway 96 includes coupling groove 66, coupling groove window 94, and the exterior of coupling retaining lip 70 about coupling end 60 of lock ring 58.

When coupling end 60 of lock ring 58 is rotated in a certain direction of rotation with respect to latch ring 62 and latch shoulder 86 is in the latched position, cam member 92 will urge collet fingers 64 radially outward from coupling groove 66, through coupling groove window 94, and to an unlatched position abutting the outer circumference of coupling retaining lip 70. In the preferred embodiment of the present invention, rotation of lock ring 58 and cam member 92 about latch ring 62 for 360 degrees of rotation in the proper direction will uncouple latch ring 62 from lock ring 58.

Operation of liner hanger 34 to secure liner 36 to the interior of the wellbore casing (not shown) is accomplished by first lowering liner hanger 34 to a preselected depth within the wellbore. With reference to FIGS. 3*a* and 3*b*, liner hanger 34 and liner 36 are run into the wellbore with slip assembly 42 coupled to liner 36 to prevent slip assembly 42 from moving with respect to cone ring 40. Slip assembly 42 is coupled to liner 36 by latch ring 62 being coupled to lock ring 58.

Referring now to FIGS. 3*a*, 3*b*, and 4, latch ring 62 is coupled to lock ring 58 by latch shoulder 86 being in a latched position with respect to coupling shoulder 68. When in this latched position, latch shoulder 86 is positioned to matingly abut coupling shoulder 68 as liner 36 is lowered downhole. As liner 36 is lowered downhole, drag spring assembly 52 is urged to stay in place within the wellbore by engagement with the casing (not shown). Drag spring assembly 52 is secured to latch shoulder 86, and urges latch shoulder 86 to stay in place within the wellbore as coupling shoulder 68 is lowered downhole with liner 36, to which is it secured. Latch shoulder 86 is then urged into mating abutment with coupling shoulder 68 in which latch shoulder 86 presses against coupling shoulder 68 and prevents movement of drag spring 52 and slip assembly 42 with respect to liner 36 and cone ring 40.

Once liner hanger 34 and liner 36 are in position, the workstring (not shown) is rotated through 360 degrees rotation to the left, which rotates liner 36 to the left for 360 degrees. As discussed above, rotation to the left is herein defined to be the direction of rotation of liner 36 which would be viewed as counter clockwise rotation when looking downhole from the surface of the wellbore. In the preferred embodiment of the present invention, rotation of liner hanger 34 to the left for 360 degrees unlatches latch ring 62 from lock ring 58, to uncoupled slip assembly 42 from liner 36.

In other embodiments of the present invention, more than one coupling groove (not shown) may be used so that less than 360° rotation is required to uncouple slip assembly 42 from liner 36. For example, four coupling grooves (not shown) could be used, and then a rotation of 90 degrees would be required for uncoupling the rotation release latch. Additionally, in other embodiments of the present invention, rotation to the right may uncouple slip assembly 42 from liner 36, rather than rotation to the left. Rotation to the right would be viewed as clockwise rotation when looking downhole from the surface of the wellbore.

Still referring to FIGS. 3*a*, 3*b*, and 4, as the workstring (not shown) is rotated to the left, drag spring assembly 52 is pressing against the casing (not shown) and results in drag spring assembly 52 being urged to remain in place within the wellbore as liner hanger 34 and liner 36 are rotated. Referring to FIGS. 5, 6, and 7, rotation of liner hanger 34 to the left while drag spring assembly 52 is urged to remain in place within the wellbore, will rotate coupling end 60 of lock ring 58 with respect to latch ring 62, and result in latch shoulder 86 rotating with respect to coupling shoulder 68 until latch shoulder 86 is radially displaced from the interior of coupling groove 66 to an unlatched position.

In the unlatched position, collet finger tip 84 is exteriorly positioned about coupling retaining lip 70 and abuts upward facing conical surface 78. When in an unlatched position, latch shoulder 86 is not in position to be urged into mating abutment with coupling 86 as liner 36 is moved downhole and drag spring assembly 52 tends to stay in place within the wellbore.

Once latch shoulder 86 is urged to an unlatched position radially disposed outward of coupling groove 66 and coupling retaining lip 70, latch ring 62 is uncoupled from lock ring 58 leaving slip assembly 42 uncoupled from liner 36 and free to move towards cone ring 40 which remains secured liner 36. Liner 36 may then be lowered downhole which moves cone ring 40 downhole and towards slip assembly 42 which is held in place within the casing (not shown) by drag spring assembly 52. Cone ring 40 then engages slip assembly 42 and wedges between slip assembly 42 and liner 36 to urge longitudinally extending slip elements 44 radially outward into gripping engagement with the casing (not shown). Further lowering of liner 36 downhole into the wellbore places the weight of liner 36 onto liner hanger 34 to further urge cone ring 40 to wedge slip elements 44 into gripping engagement until liner 36 is secured within the casing (not shown).

The preferred embodiment of the present invention has several advantages over the prior art. Rotation release latch 56 may be operated to uncouple slip assembly 42 from liner 36 for setting slip gripping mechanism 38 without requiring axial movement of liner hanger 34. Rotation release latch 56 may be operated by rotation of liner hanger 34 to uncouple latch ring 62 from lock ring 58. Since axial movement of liner 36 is not required to operate rotation release latch 56, there is not a problem of determining when sufficient axial movement has been provided downhole to liner hanger 34 to operate rotation release latch 56. Additionally, since axial movement is not required for operation of rotation release latch 56, there is not a problem of disengaging surface slips (not shown) from grippingly engaging the workstring (not shown) in the rotary table (not shown). Further, if debris becomes lodged within coupling groove 66 of rotation release latch 56, the debris may be displaced from coupling groove 66 as collet fingers 64 are rotated from a latched to an unlatched position, with collet fingers 64 wiping the debris out of coupling groove 66.

Although the rotation release apparatus of the present invention has been described herein embodied for use in a liner hanger, it may be used to releasably couple wellbore tool members other than a liner hanger slip gripping mechanism, and thus is not limited to either liner hangers or slip gripping mechanism. While the invention has been shown in only one of its forms, it is thus not limited but is susceptible to various changes and modifications without departing from the spirit thereof.

What is claimed is:

1. A rotation release latch for use in a wellbore tool to selectively couple a first wellbore tool member to a second wellbore tool member by manipulating a workstring to which said wellbore tool is secured, said rotation release latch comprising:

a lock ring secured to said first wellbore tool member and having a coupling end which includes at least one coupling groove circumferentially disposed about said coupling end, each of said at least one coupling grooves defining a pathway about said coupling end and having a coupling shoulder circumferentially extending from said coupling end to provide a collet collar;

a latch ring secured to said second wellbore tool member, and having at least one collet finger which extends longitudinally for insertion into a latched position within one of said at least one coupling grooves of said coupling end of said lock ring, each of said at least one collet fingers including a collet finger shoulder extending therefrom for a mating abutment with said coupling shoulder of one of said at least one coupling grooves when said at least one collet finger is inserted into said latched position therein;

at least one cam member positioned for urging said at least one collet finger from said at least one coupling groove to an unlatched position wherein said at least one collet finger is disposed exteriorly of said at least one coupling groove;

wherein each of said at least one collet fingers are selectively positionable into said latched position disposed within one of said at least one coupling grooves in said coupling end, with said collet finger shoulder positioned for said mating abutment with said coupling shoulder to prevent movement between said first wellbore tool member and said second wellbore tool member in at least one longitudinal direction; and wherein rotation of said workstring selectively uncouples said first wellbore tool member from said second wellbore tool member by rotating said latch ring with respect to said coupling end of said lock ring to move said at least one collet finger past said cam member which urges said at least one collet finger to said unlatched position where said at least one collet finger is disposed exteriorly of said at least one coupling groove.

2. The wellbore tool of claim 1, wherein said wellbore tool further comprises:

said collet finger including a spring biasing member which at least in part urges said at least one collet finger to insert into said latched position within one of said at least one coupling grooves when said it least one collet finger is disposed in at least one unlatched position radially adjacent to one of said at least one coupling grooves.

3. The apparatus of claim 1, further comprising:

at least one coupling retaining lip which at least in part retains said at least one collet finger in said latched position and in said unlatched position when said at least one collet finger is disposed therein; and said at least on coupling retaining lip having a window for said at least one collet finger to pass through when moving between said latched and said unlatched positions.

4. A wellbore tool for use in a wellbore to selectively couple a workstring to a wellbore member by manipulation of said workstring, said wellbore tool comprising:

a first wellbore tool member;

a second wellbore tool member;

a lock ring secured to said first wellbore tool member and having a coupling end which includes at least one coupling groove circumferentially disposed about said coupling end, each of said at least one coupling grooves defining a pathway about said coupling end which includes a cam member and a coupling shoulder circumferentially extending from said coupling end to provide a collet collar;

a latch ring secured to said second wellbore tool member, and having at least one collet finger which extends longitudinally for insertion into a latched position within one of said at least one coupling grooves of said coupling end of said lock ring, each of said at least one collet fingers including:

a collet finger shoulder extending radially for a mating abutment with said coupling shoulder of one of said at least one coupling grooves when said at least one collet finger is inserted into said latched position therein;

a collet finger spring bias radially urging said at least one collet finger to insert into said latched position within one of said at least one coupling grooves when said at least one collet finger is disposed radially adjacent to one of said at least one coupling grooves;

wherein each of said at least one collet fingers are selectively positionable into said latched position disposed within one of said at least one coupling grooves in said coupling end, with said collet finger shoulder positioned for said mating abutment with said coupling shoulder to prevent movement between said first wellbore tool member and said second wellbore tool member in at least one longitudinal direction; and wherein a rotation of said workstring selectively uncouples said first wellbore tool member from said second wellbore tool member by rotating said latch ring with respect to said coupling end of said lock ring to move said at least one collet finger past said cam member which urges said at least one collet finger to said unlatched position where said at least on collet finger is disposed exteriorly of said at least one coupling groove.

5. The apparatus of claim 4, further comprising:

at least one coupling retaining lip extending circumferentially about said coupling end of said lock ring to further define at least a portion of said at least one coupling groove, and having a nominal longitudinal lip dimension and a reduced longitudinal lip dimension which defines a groove window included in said groove pathway disposed in proximity to said cam member of each of said at least one coupling grooves; and wherein said at least one coupling retaining lip abuts said at least one collet finger to prevent insertion of said at least one collet finger into said engagement within said at least one coupling groove when said at least one collet finger is disposed radially exterior of said at least one coupling groove.

6. The apparatus of claim 4, further comprising:

at least one coupling retaining lip extending circumferentially about said coupling end of said lock ring to further define at least a portion of said at least one coupling grooves, said at least one coupling retaining lip disposed away from said coupling shoulder by a coupling gap which includes both a longitudinal gap dimension and a radial gap dimension, said coupling gap having an increased longitudinal gap dimension where said coupling retaining lip has a reduced longitudinal lip dimension to define a groove window included in said groove pathway disposed in proximity to said cam member of each of said at least one coupling grooves, and said coupling gap having a nominal longitudinal gap dimension where said coupling retaining lip has said nominal longitudinal lip dimension;

each of said at least one collet fingers including a collet finger tip having a radially extending tip width which is smaller than said radial gap dimension, and a longitudinally extending tip length which is both larger than said nominal longitudinal gap dimension, yet smaller than said longitudinal gap dimension where said coupling retaining lip is at said increased longitudinal gap dimension;

wherein said at least one coupling retaining lip abuts said at least one collet finger to prevent insertion of said at least one collet finger into said engagement within said at least one coupling groove when said at least one collet finger is disposed radially exterior of said at least one coupling groove at said nominal longitudinal lip dimension;

wherein an axial manipulation of said workstring selectively couples said first wellbore tool member and said second wellbore tool member by selectively positioning said at least one collet finger about said lock ring in said latched position within one of said at least one coupling grooves, said axial movement of said workstring moving said latch ring relative said coupling end of said lock ring to urge said collet finger tip within said one of said at least one coupling grooves by passing said tip through said coupling gap;

wherein said collet finger spring bias radially urges said at least one collet finger into said latched position in one of said at least one coupling grooves to position said collet finger shoulder for mating abutment with said coupling shoulder to prevent movement between said first wellbore tool member and said second wellbore tool member in one longitudinal direction; and said at least one coupling retaining lip abutting said at least one collet finger at said nominal lip dimension for maintaining said at least one collet finger in said latched position.

7. The wellbore tool of claim 4, wherein said rotational manipulation selectively releases said first wellbore tool member from said second wellbore tool member when said workstring is rotated about a longitudinal axis of said workstring rotates said lock ring secured to said workstring through less than 360 degrees angular displacement with respect to said latch ring.

8. The wellbore tool of claim 4, wherein said lock ring and said latch ring are disposed about a tubular conduit, and said first and second wellbore tool members are included as a portion of a slip gripping mechanism for securing said tubular conduit within said wellbore.

9. A liner hanger for securing a liner within to casing string by manipulation of a workstring to which said liner is secured; said liner hanger comprising:

a slip gripping mechanism circumferentially disposed about said liner and including a first slip gripping member and a second slip gripping member, wherein said first slip gripping member is moved longitudinally with respect said second slip gripping member to secure said liner within said casing string;

a lock ring circumferentially disposed about said liner and secured to said first slip gripping member, said lock ring having a coupling end which includes at least one coupling groove forming a pathway circumferentially disposed about said coupling end of said lock ring, each of said at least one coupling grooves including:

a coupling shoulder extending circumferentially about said liner, defines a portion of said coupling groove, and provides a collet collar;

a coupling retaining lip extending circumferentially about said liner and defining a portion of said coupling groove, and has a nominal longitudinal lip dimension and a reduced longitudinal lip dimension;

said coupling retaining lip disposed away from said coupling shoulder by a coupling groove gap which includes both a longitudinal gap dimension and a radial gap dimension, and said coupling groove gap having an increased longitudinal gap dimension defining a coupling groove window where said coupling retaining lip has said reduced longitudinal lip dimension and a nominal longitudinal gap dimension where said coupling retaining lip has said nominal longitudinal lip dimension;

a cam member disposed circumferentially about said liner and within said at least on coupling groove proximate to said window;

a latch ring circumferentially disposed about said liner and secured to said second slip gripping member, said latch ring having at least one longitudinally extending collet finger, each of said at least one collet fingers including:

a collet finger tip having a radially extending tip width which is smaller than said radial gap dimension, and a longitudinally extending tip length which is both larger than said nominal longitudinal gap dimension, yet smaller than said increased longitudinal gap dimension defining said coupling groove window;

a collet finger shoulder which is included as a portion of said collet finger tip and extends circumferentially about said liner, said collet finger shoulder facing in an opposite direction to said coupling shoulder for a mating abutment with said coupling shoulder;

a collet finger spring bias which radially urges said at least one collet finger into one of said at least one coupling grooves when said collet finger tip is adjacent to said at least one coupling groove to position said collet finger shoulder for said mating abutment with said coupling shoulder;

each of said at least one collet fingers positionable in a plurality of positions which include:

a latched position wherein said at least one collet finger is disposed within one of said at least one coupling grooves, with said collet finger shoulder in a mating abutment with said coupling shoulder to prevent movement between said first slip gripping member and said second slip gripping in at least one longitudinal direction with respect to said liner;

an unlatched position wherein said at least one collet finger is disposed exteriorly of each of said at least one coupling grooves, and said collet finger retaining lip of one of said at least one grooves abuts said collet finger tip at said nominal lip dimension to prevent entry of said at least one collet finger into said at least one coupling grooves to prevent said mating abutment between said collet finger shoulder and said coupling shoulder of one of said at least one coupling grooves;

wherein an axial movement of said workstring selectively couples said first slip gripping member and said second slip gripping member by selectively positioning each of said at least one collet fingers about said lock ring in said latched position within one of said at least one coupling grooves, said axial movement of said workstring moving said latch ring relative to said coupling end of said lock ring to urge said collet finger tip within one of said at least one coupling grooves by passing said tip through said coupling gap, and said collet finger spring bias radially urging said collet finger shoulder into said latched position for mating abutment with said coupling shoulder to prevent movement in at least one longitudinal direction between said first slip gripping member and said second slip gripping member; and wherein a rotation of said workstring selectively uncouples said first slip gripping member from said second slip gripping member by selectively positioning each of said at least one collet fingers about said coupling end of said lock ring in said unlatched position, said rotation of said workstring moving said latch ring with respect to said lock ring to selectively position each of said at least one collet fingers into said unlatched position exterior of each of said at least one coupling grooves by said at least one collet fingers passing by one of said cam members which urges each of said collet finger tips through one of said windows and from said at least one groove to selectively release said first wellbore tool member from said second wellbore tool member.

10. The liner hanger of claim 9, wherein said first slip gripping member is a cone assembly circumferentially disposed about said liner and having at least one longitudinally extending cone element which is secured to said lock ring and said liner;

wherein said second slip gripping member is a slip assembly having a plurality of longitudinally extending slip elements, which are secured to said latch ring and selectively coupled to said lock ring which secured to said liner; and wherein rotation of said workstring about a longitudinal axis of said workstring through less than 360 degrees angular displacement selectively releases said latch ring from said lock ring to allow said plurality of longitudinally extending slip elements to move towards said at least one longitudinally extending cone element.

* * * * *